United States Patent [19]

Avril

[11] 4,262,429

[45] Apr. 21, 1981

[54] METHOD OF AND APPARATUS FOR DRYING MATERIALS

[76] Inventor: Arthur C. Avril, P.O. Box 17087, Cincinnati, Ohio 45217

[21] Appl. No.: 53,335

[22] Filed: Jun. 29, 1979

Related U.S. Application Data

[63] Continuation-in-part of Ser. No. 652,632, Jan. 26, 1976, abandoned.

[51] Int. Cl.[3] ..... F26B 3/04; F26B 11/04

[52] U.S. Cl. ..... 34/33; 34/132; 34/136; 34/128; 34/129; 432/108; 366/15; 366/25

[58] Field of Search ..... 366/12, 15, 24, 25, 366/51, 228; 432/108, 111, 106; 34/128, 129, 135, 136, 137, 141, 33, 132, 28, 31

[56] References Cited

U.S. PATENT DOCUMENTS

| | | | |
|---|---|---|---|
| 1,240,481 | 9/1917 | Porkess | 366/25 |
| 1,370,085 | 3/1921 | Burman | 34/128 |
| 2,487,887 | 11/1949 | McEachran | 366/15 |
| 3,514,870 | 6/1970 | Avril | 34/108 |
| 4,075,710 | 2/1978 | Jakob et al. | 366/25 |

FOREIGN PATENT DOCUMENTS

| | | | |
|---|---|---|---|
| 22709 | 12/1917 | Denmark | 34/128 |

*Primary Examiner*—Larry I. Schwartz
*Attorney, Agent, or Firm*—James W. Pearce; Roy F. Schaeperklaus

[57] ABSTRACT

An apparatus for drying two materials comprising two coaxial cylinders, means for rotating the coaxial cylinders, means for introducing a first material into one end of the inner cylinder, means for heating the first material, means for moving the first material in response to the rotation of the cylinders along the interior of the inner cylinder so same is discharged from a second end thereof into an adjacent end of the outer cylinder, means for introducing a second material into the said adjacent end of the outer cylinder, and means for moving the first and second materials in response to the rotation of the cylinders along the interior of the outer cylinder in a direction contra to that of the movement of the first material in the inner cylinder so said first and second materials are discharged from the other end of the outer cylinder. The first material is dried in the inner cylinder by direct heating. The second material is dried in the outer cylinder by the heat exchange between the inner and outer cylinders and the first and second materials thereby conserving energy.

10 Claims, 3 Drawing Figures

METHOD OF AND APPARATUS FOR DRYING MATERIALS

This is a continuation-in-part of my copending application Ser. No. 652,632, filed Jan. 26, 1976 now abandoned.

FIELD OF THE INVENTION

This invention relates to the manufacture of premixed dried packaged concrete and more particularly to apparatuses for drying the sand, sometimes also called fine aggregate and gravel, sometimes also called coarse aggregate.

DESCRIPTION OF THE PRIOR ART

At the present time, for a small concrete job or repair work requiring a small volume of concrete, concrete is available in small packages. That is, the cement, sand and aggregate are mixed and packaged in dried condition so that the only thing the purchaser does is to mix the contents of the package with water and pour. The dried packaged concrete is used for work which requires a limited amount of concrete, the use of the packaged material being convenient to handle and economical because it eliminates the waste of materials.

The sand and aggregate, usually gravel, normally are in moist condition when shipped from the source of supply. Since the sand and gravel must be dried thoroughly before mixing and packaging, this presents a problem in the preparation of dry packaged concrete.

Various apparatuses exist in the prior art to dry the sand and gravel for packaging. One of these apparatuses consists of a single cylinder which is heated and into which both moist sand and moist gravel are introduced. In the single cylinder dryer, the sand and gravel mixture is heated to a temperature above 250 degrees. Since the package is usually made up of paper or plastic, it would be damaged if sand and gravel at a temperature of 250 degrees were introduced into it. Accordingly, the sand and gravel must be cooled down to a temperature of less than 140 degrees Fahrenheit. This apparatus is disadvantageous because it wastes heat, has a low production capacity due to the long cool down time of the mixture, and generates a high number of pollutants which must be filtered out.

In order to overcome the above-described disadvantages, a drying apparatus consisting of two cylinders, one of which is heated and one of which is unheated, has been developed. One such drying apparatus is disclosed in U.S. Pat. No. 2,904,942. In such a drying apparatus sand is introduced into the heated cylinder and dried. The hot sand together with the wet gravel is introduced into the second unheated cylinder and as the sand and wet gravel move through the cylinder the gravel is dried and the sand is cooled by the heat exchange between the sand and gravel. This apparatus results in a savings of approximately 30% of the heat over the previous method and is faster; but with the advent of the "oil crisis," this apparatus also wastes too much heat. Furthermore, this apparatus still generates a high number of pollutants.

Accordingly, it is a general object of the present invention to provide an apparatus for drying two materials which wastes a small amount of energy.

It is another object of the present invention to provide an appartus for drying two materials having a high production capacity.

It is yet another object of the present invention to provide an apparatus for drying two materials which is simple to manufacture.

It is still another object of the present invention to provide an apparatus for drying two materials which generates less pollutants.

SUMMARY OF THE INVENTION

In keeping with the principles of the present invention, the objects are accomplished with the unique combination of two coaxial cylinders, the inner cylinder being substantially shorter than the outer cylinder, means for rotating the coaxial cylinders about their central axis, means for introducing a moist first material into one end of the inner cylinder, means for heating the first material, means for moving the first material in response to the rotation of the cylinders along the interior of the inner cylinder, means for introducing a moist second material into the end of the outer cylinder opposite that the first material is introduced, and means for moving the first and second materials in response to the rotation of the cylinders along the interior of the outer cylinder in a direction contra to that of the first material in the inner cylinder. The first material is dried as it moves along the inner cylinder by direct heating. Since the inner cylinder is substantially shorter than the outer cylinder, the dry first material is introduced into the outer cylinder after it passes through the inner cylinder. The moist second material is dried by the heat radiated by the inner cylinder and the heat exchange between the dry first material and the wet second material. Since the heat radiated from the inner cylinder is utilized to dry the wet moist second material, energy is conserved and less fuel is used to dry the first and second materials. Furthermore, the temperature of the first material is reduced by its contact with the moist second material thereby reducing the temperature of the output dry first and second materials.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which.

DESCRIPTION OF THE PREFERRED EMBODIMENT

Figure 1:
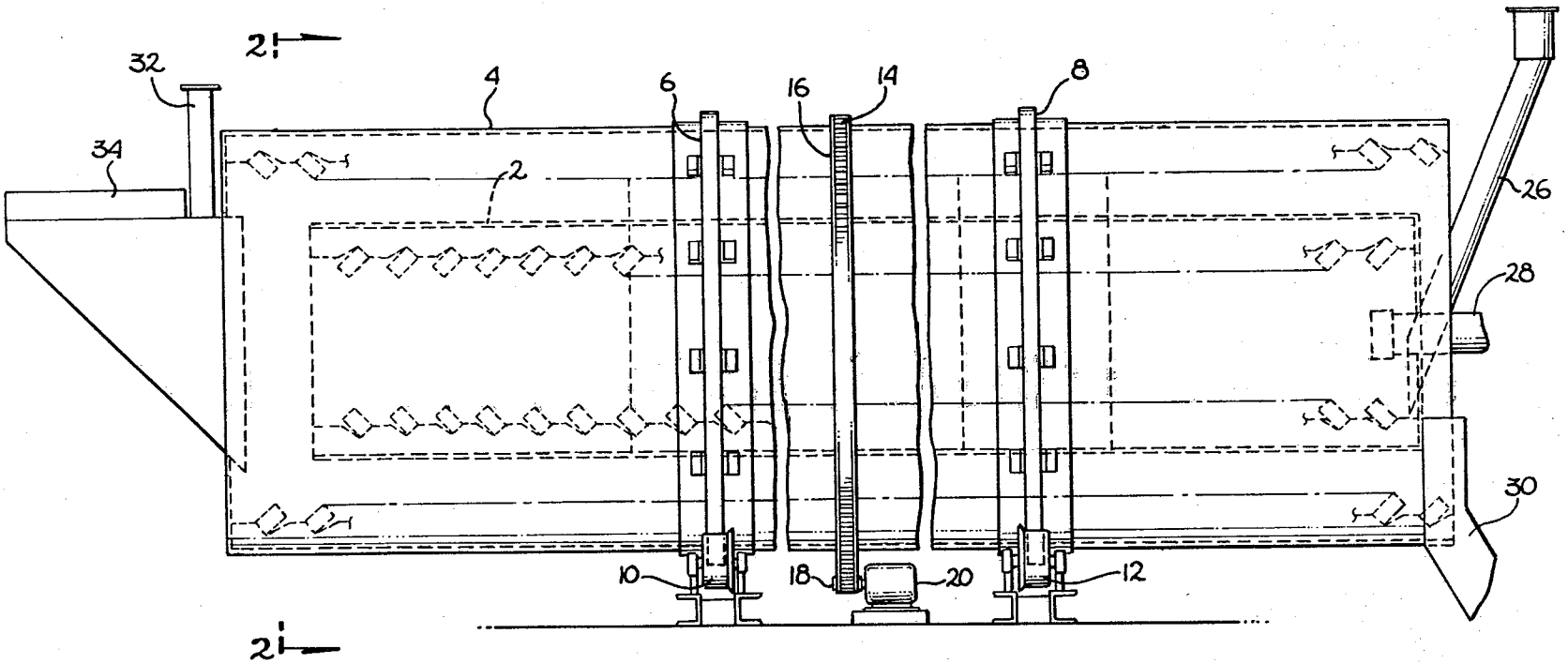
FIG. 1 is a simplified side view of a drying apparatus in accordance with the teachings of the present invention.
Figure 2:
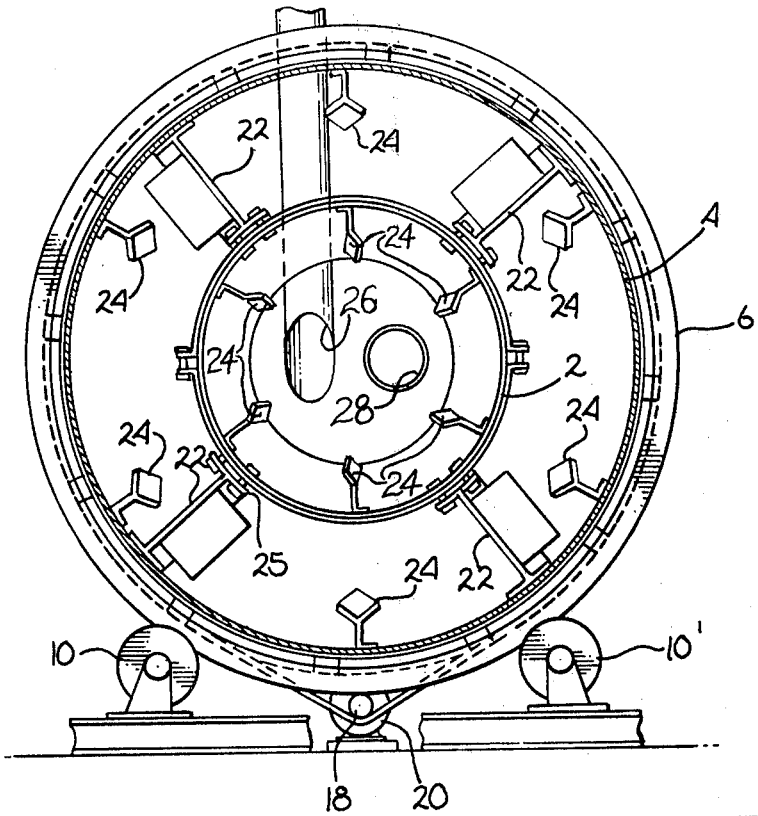
FIG. 2 is a sectional view of the drying apparatus of FIG. 1 looking along the lines of 2—2 and with the discharge chute omitted.

Referring to the drying apparatus shown in FIGS. 1 and 2, the drying apparatus includes two coaxial cylinders 2 and 4. Coaxial cylinders 2 and 4 form a double shell structure. Inner cylinder 2 is shorter in length than outer cylinder 4. Outer cylinder 4 includes bands 6 and 8 and is supported by sets of rollers 10 and 12 tracking respectively on trunnion bands 6 and 8. Outer cylinder 4 also includes a sprocket ring 14 and a chain 16 which meshes with sprocket ring 14. Chain 16 also meshes with a sprocket 18 coupled to the output shaft of motor 20. Sprocket ring 14, chain 16, together with sprocket 18 and motor 20 operate in substantially the same manner as disclosed in U.S. Pat. No. 3,514,870.

The outer cylinder is supported on inner cylinder 2 by I beam supports 22 which are welded to outer cylinder 4 and bolted to inner cylinder 2. The construction of supports 22 is described later in conjunction with FIG. 3. Furthermore, a plurality of impellers 24 are mounted radially about and extending longitudinally along the interior of both inner and outer cylinders 2 and 4.

Sand chute 26, burner 28 and discharge chute 30 are mounted at one end of the coaxial cylinders 2 and 4. Sand chute 26 extends within inner cylinder 2 together with burner 28. Discharge chute 30 is mounted toward the bottom of the outer cylinder 4 and collects the dry and gravel mixture as it spills out of cylinder 4.

At the opposite end of coaxial cylinders 2 and 4 are mounted gravel chute 32 and flue 34. Gravel chute 32 extends within outer cylinder 4 and is constructed integrally with flue 34. An exhaust fan, not shown, is coupled to flue 34.

In practice, impellers 24 may be the same as the lifting vanes described in U.S. Pat. No. 3,514,870. Furthermore, cylinders 2 and 4 may be made from any high temperature metal and burner 28 may burn natural gas or any flammable, volatile liquid or gas. In addition, since inner cylinder 2 expands and contracts with temperature changes, a small space 25 is left between eye beam supports 22 and the outside surface of inner cylinder 2.

In operation, assume first that coaxial cylinders 2 and 4 are being rotated by motor 20 via chain 16 and sprockets 14 and 18 and that burner 28 is lighted and discharging hot gases into inner cylinder 2. First, sand is introduced into the inner cylinder 2 via sand chute 26. As the coaxial cylinders 2 and 4 rotate, the moist sand is moved in a horizontal direction by the impeller blades 24. The impeller blades 24 not only move the sand in a horizontal direction but also lift it so that it falls onto the interior of the inner cylinder. As the sand moves through the inner cylinder 2, it is heated by the hot gases from burner 28 thereby drying out the moist sand as it travels through the inner cylinder 2. When the dry sand reaches the outer end of inner cylinder 2 it is discharged into outer cylinder 4.

After the dry sand starts to be discharged into outer cylinder 4 from inner cylinder 2, moist gravel is introduced into outer cylinder 4 via gravel chute 32. In a similar manner as previously described, the impeller blades move the sand and gravel mixture in a direction contra to that of the sand in cylinder 2. The heat radiated from inner cylinder 2 heats the moist gravel as it travels horizontally in outer cylinder 4. Furthermore, the contact between the moist gravel and the dry sand also heats the gravel and reduces the temperature of the sand. The combined sand and gravel is moved along the outer cylinder 4 and discharged into discharge chute 30 for further processing and packaging. Since the temperature of the sand is reduced by contact with the moist gravel, the temperature of the discharged mixture can be kept below 140 degrees Fahrenheit. Furthermore, since the heat radiated by inner cylinder 2 is not wasted, a drying apparatus according to the present invention utilizes up to 30 percent less energy than prior art dryers.

During the operation of the drying apparatus, pollutants, viz., dust, gases and moisture, are created within coaxial cylinders 2 and 4. Since the diameter of the drying apparatus is greater than that of the prior art dryers, the velocity of the air flowing through the dryer is less for the same volume of air per unit time. Since the air flow velocity is reduced, the amount of particles carried by the air is reduced thereby reducing the discharge of air borne pollutants. Furthermore, since wet gravel is being introduced into the end of the dryer toward which the dust from the dry sand is flowing, some of the dust is picked up by the wet gravel thereby further reducing the pollutants. The pollutants which are created by the drying apparatus are drawn up through flue 34 by the exhaust fan, not shown, and filtered out before discharging the air into the atmosphere.

Figure 3:
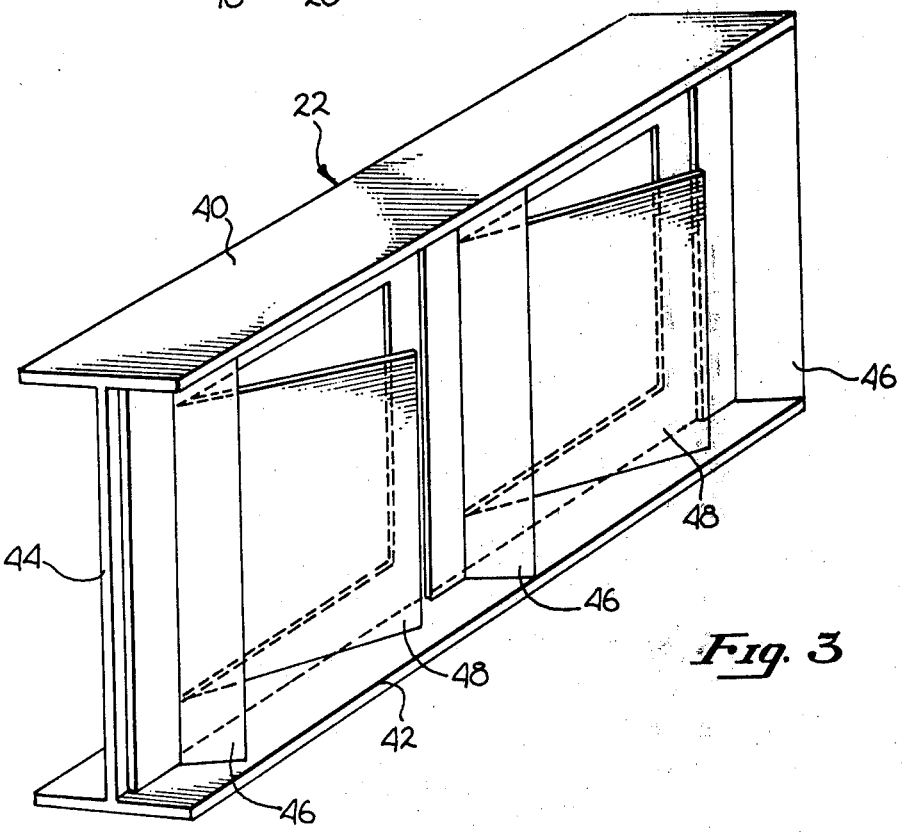
FIG. 3 is a pictorial view of the inner-outer eye beam supports utilized in the drying apparatus of FIG. 1.

Referring to FIG. 3, shown therein is a pictorial view of one I beam support 22. Support 22 in cross-section is substantially in the shape of an "I" having an upper and lower cross bar 40 and 42 and a stem 44 extending between the upper and lower cross bars 40 and 42. Support 22 is reinforced at both ends and the middle by lengths of angle iron 46 welded to the stem 44 and extending between the upper and lower cross bars 40 and 42. Vanes 48 are cut out of the stem portion of support 22 and bent up at an angle of between 60 and 70 degrees to the stem portion 44 of support 22. In operation, the vanes 48 in supports 22 act substantially in the same way as the impellers 24 to move the sand and gravel mixture through the outer cylinder. Since the vanes 48 act substantially the same as the impellers 24, the collection of sand and gravel around the supports 22 is reduced.

It should be apparent to one skilled in the art that the present invention could be used to dry any two materials and is not limited to sand and gravel.

In all cases it is understood that the above described embodiment is merely illustrative of but one of the many possible embodiments which can represent application of the principles of the present invention. Numerous and varied other arrangements can be readily devised in accordance with these principles by those skilled in the art without departing from the spirit and scope of the present invention.

I claim:

1. A method for forming a dry aggregate mixture comprising the steps of:

moving a stream of a moist fine aggregate through an inner cylinder of two coaxial cylinders, the inner cylinder being within an outer of the cylinders;

heating said fine aggregate by means of heat from a heat source adjacent the end of the inner cylinder into which fine aggregate is introduced to a temperature sufficient to dry said fine aggregate;

mixing the stream of said dry fine aggregate with a stream of a moist coarse aggregate in the outer cylinder of said coaxial cylinders;

moving said mixed stream of said fine aggregate and said coarse aggregate through said outer cylinder of said coaxial cylinders in a direction opposite to the flow of said fine aggregate in said inner cylinder and moving a gaseous atmosphere through said outer cylinder in a direction opposite the flow of said mixed stream through said outer cylinder whereby said coarse aggregate is dried by the heat exchange between said inner and outer cylinders and between said fine aggregate and said coarse aggregate and the gaseous atmosphere in said outer cylinder, while the temperature of said fine aggregate is lowered substantially.

2. The method for forming a dry aggregate mixture according to claim 1 wherein said fine aggregate and coarse aggregate are respectively sand and gravel.

3. The method for forming a dry aggregate mixture according to claim 1 wherein said temperature of said fine aggregate is lowered to less than 140 degrees Fahrenheit.

4. The method for forming a dry aggregate mixture according to claim 3 wherein said fine aggregate is heated to a temperature greater than 250 degrees Fahrenheit.

5. The method for forming a dry aggregate mixture according to claim 4 further comprising the step of moving a low velocity stream of air through said coaxial cylinders whereby the number of particles picked up by said stream of air is maintained at low concentration in said air.

6. An apparatus for drying a fine aggregate and a coarse aggregate comprising:

an outer cylinder having a first end and a second end;

an inner cylinder having a first end and a second end mounted concentrically within the outer cylinder;

means rotating said outer cylinder and the inner cylinder mounted therein, a gaseous atmosphere in each cylinder and moving at low velocity from the first end of each cylinder to the second end of each cylinder in like direction;

means adding heat and products of combustion to the atmosphere in the inner cylinder;

means feeding moist fine aggregate into the first end of the inner cylinder;

the means for adding heat and products of combustion being located adjacent the first end of the inner cylinder;

impellers extending radially inwardly from the inner cylinder impelling the fine aggregate toward the second end of the inner cylinder and causing cascading of said first material through the atmosphere in said inner cylinder;

the fine aggregate discharging from the second end of the inner cylinder into the outer cylinder inboard of the second end thereof;

means feeding moist coarse aggregate into the second end of the outer cylinder, the outer cylinder having impellers projecting inwardly toward the inner cylinder and moving in unison with the rotating cylinders, said impellers advancing the aggregate from the second end of the outer cylinder to the first end thereof while stirring and lifting said aggregate to cascade against the outer surface of the inner cylinder and through the atmosphere in the outer cylinder until the aggregate is discharged from the first end of the outer cylinder whereby the moist fine aggregate undergoes drying and elevation of its temperature as it advances through the inner cylinder, and, the fine aggregate undergoes cooling while the coarse aggregate undergoes heating and cooling as they pass from the second end to the first end of the outer cylinder wherein the temperature gradient of the atmosphere decreases from the second to the first end of the outer cylinder.

7. An apparatus for drying fine and coarse aggregate comprising:

an outer rotatable cylinder having first and second ends;

an inner cylinder, said inner cylinder being shorter in length than said outer cylinder and being mounted within and coaxially with said outer cylinder, said inner cylinder further having third and fourth ends, said third and fourth ends being respectively adjacent said first and second ends;

a means for rotatably supporting said outer cylinder;

a means for rotating said outer cylinder;

a means for introducing moist fine aggregate into said third end of said inner cylinder;

a source of heat located adjacent said third end for heating said moist fine aggregate and said inner cylinder;

a means for moving said fine aggregate through said inner cylinder and out said fourth end of said inner cylinder and into said second end of said outer cylinder in a continuous stream and for lifting said fine aggregate such that said fine aggregate falls onto the interior of said inner cylinder;

a means for introducing moist coarse aggregate into said second end of said outer cylinder;

means for moving said fine and coarse aggregate through said outer cylinder in a direction opposite to the flow of said fine aggregate in said inner cylinder and for lifting said fine and coarse aggregate such that said fine and coarse aggregate fall downwardly; and, means moving a low velocity stream of air moving through said cylinders in the direction of movement of the fine aggregate through said second cylinder whereby said fine and coarse aggregate absorb heat from said inner cylinder and said coarse aggregate absorbs heat from said fine aggregate and same heat said stream of air and are thereby completely dried in a continuous operation and discharged from said outer cylinder at reduced temperatures.

8. An apparatus for drying fine and coarse aggregate comprising:

an outer rotatable cylinder having first and second ends;

an inner cylinder, said inner cylinder being shorter in length than said outer cylinder and being mounted within and coaxially with said outer cylinder, said inner cylinder further having third and fourth ends, said third and fourth ends being respectively adjacent said first and second ends;

a means for rotatably supporting said outer cylinder;

a means for rotating said ouer cylinder;

a means for introducing moist fine aggregate into said third end of said inner cylinder;

a source of heat located adjacent said third end for heating said moist fine aggregate and said inner cylinder;

a means for moving said fine aggregate through said inner cylinder and out said fourth end of said inner cylinder and into said second end of said outer cylinder in a continuous stream and for lifting said fine aggregate such that said fine aggregate falls onto the interior of said inner cylinder;

a means for introducing moist coarse aggregate into said second end of said outer cylinder; and means for moving said fine and coarse aggregate through said outer cylinder in a direction opposite to the flow of said fine aggregate in said inner cylinder and for lifting said fine and coarse aggregate such that said fine and coarse aggregate fall downwardly whereby said fine and coarse aggregate absorb heat from said inner cylinder and are thereby completely dried in a continuous operation.

9. An apparatus for drying a first and second material comprising:

a first rotatable cylinder having first and second ends;

a second cylinder, said second cylinder being mounted within and coaxialy with said first cylinder, said second cylinder further having third and fourth ends, said third and fourth ends being respectively adjacent said first and second ends;

a means for rotating said first cylinder, the means for rotating said first cylinder comprising a sprocket ring on said first cylinder, a motor, said motor having an output shaft, a sprocket gear on said output shaft, and a chain engaging with said sprocket ring and said sprocket gear;

a means for introducing a moist first material into said third end of said second cylinder;

a means for heating said moist first material;

a means for moving said first material through said second cylinder and out said fourth end of said second cylinder and into said second end of said first cylinder in a continuous stream and for lifting said first material such that said first material falls onto the interior surface of said second cylinder, said means for moving said first material through said second cylinder comprises a plurality of impellers being spaced radially about the interior of said second cylinder and extending longitudinally thereof;

a means for introducing a moist second material into said second end of said first cylinder, said first and second materials comprise sand and gravel;

means for moving said first and second materials through said first cylinder in a direction opposite to the flow of said first material in said second cylinder and opposite to the flow of gases through said first cylinder and for lifting said first and second material such that said first and second materials fall downwardly whereby said first and second materials are completely dried in a continuous operation, said means for moving said first and second materials through said first cylinder comprises a plurality of impellers spaced radially about the interior of said first cylinder and extending longitudinally thereof, a plurality of I beam supports spaced radially about the interior of said first cylinder, said I beam supports being coupled to the interior of said first cylinder and coupled to the exterior of said second cylinder such that a gap exists between said I beam supports and said exterior of said second cylinder thereby allowing said second cylinder to expand and contract.

10. An apparatus for drying a first and second material according to claim 9 wherein each of said I beam supports further comprises at least one vane cut out of said I beam support and coupled to said support along one edge, said vane forming an angle between 60 and 70 degrees with said support.

* * * * *